US008011655B2

(12) United States Patent
Ohishi et al.

(10) Patent No.: US 8,011,655 B2
(45) Date of Patent: Sep. 6, 2011

(54) SHEET FEEDING APPARATUS WITH MECHANISM FOR DETECTING SHEET FEEDING STATE AND SHEET FEEDING METHOD

(75) Inventors: Masatsugu Ohishi, Nishinomiya (JP); Masaharu Kimura, Daito (JP); Norichika Katsura, Tenri (JP); Masaya Asakawa, Yamatokoriyama (JP); Yasuaki Fukada, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 262 days.

(21) Appl. No.: 12/356,111

(22) Filed: Jan. 20, 2009

(65) Prior Publication Data

US 2009/0189339 A1 Jul. 30, 2009

(30) Foreign Application Priority Data

Jan. 28, 2008 (JP) ..... 2008-015830

(51) Int. Cl.
*B65H 7/02* (2006.01)

(52) U.S. Cl. ..... 271/259; 271/256; 271/258.02

(58) Field of Classification Search ..... 271/259, 271/258.02, 258.03, 256, 258.01
See application file for complete search history.

(56) References Cited

U.S. PATENT DOCUMENTS 4,757,984 A * 7/1988 Rowe et al. ..... 270/58.03
4,775,139 A * 10/1988 Honjo et al. ..... 271/10.03
5,667,215 A * 9/1997 Yoshino ..... 271/258.01
6,978,997 B2 * 12/2005 Able et al. ..... 271/258.01
7,690,649 B2 * 4/2010 Davies et al. ..... 271/259
2006/0017216 A1 * 1/2006 Mitsuya et al. ..... 271/121
2006/0186594 A1 * 8/2006 Mitsuya et al. ..... 271/262

FOREIGN PATENT DOCUMENTS

JP 9-100048 A 4/1997
JP 09-124173 5/1997
JP 2006-082889 A 3/2006
JP 2007-153533 6/2007
JP 2007-206572 8/2007
JP 2008-082889 4/2008

* cited by examiner

*Primary Examiner* — Stefanos Karmis
*Assistant Examiner* — Howard Sanders
(74) *Attorney, Agent, or Firm* — Renner, Otto, Boisselle & Sklar, LLP

(57) ABSTRACT

A sheet feeding apparatus includes first and second sheet sensors provided in order from upstream to downstream sides in feeding direction on a paper feed path, sheet conveyor roller sets arranged along the path, and a roller controller individually controlling groups of rollers on the upstream and downstream sides of the first sheet sensor, in response to a change in values of output signals from first and second sheet sensors. The roller controller includes an overlapped feeding determining device outputting a determination signal assuming a first value when overlapped feeding occurs and a second value otherwise, in response to the change in values of the output signals from the sensors, an overlapped feeding eliminating device eliminating overlapped feeding by controlling the roller controller upon receiving the determination signal of the first value, and a conveyor roller stopping device stopping the sheet conveyor rollers if the overlapped feeding eliminating process should fail.

13 Claims, 12 Drawing Sheets

SHEET FEEDING APPARATUS WITH MECHANISM FOR DETECTING SHEET FEEDING STATE AND SHEET FEEDING METHOD

CROSS-REFERENCE TO RELATED APPLICATION

This nonprovisional application claims priority under 35 U.S.C. §119(a) on Patent Application No. 2008-015830 filed in Japan on Jan. 28, 2008, the entire contents of which are hereby incorporated by reference.

BACKGROUND OF THE INVENTION

1. Field of the Invention

The present invention relates to a sheet feeding apparatus and, more specifically, to a technique for detecting state of sheet feeding on a paper feed path.

2. Description of the Background Art

As is well known, an image forming apparatus such as a printer or a copying machine is provided with a paper feeder for feeding sheets of paper one by one. If a mechanism for separating sheets of paper in the paper feeder does not work well, overlapped feeding occurs.

The term "overlapped feeding" means that a plurality of sheets are fed together, with a part of one sheet overlapped by a part of another sheet.

Japanese Patent Laying-Open No. 9-124173 (hereinafter referred to as "'173 application") proposes a technique of mechanically preventing overlapped feeding by providing a peeling means that freely moves to be attached to/detached from one surface of a sheet, between a sheet feeding function and an image forming function.

Recently, however, various types of sheets having different colors, thicknesses and materials are used. Depending on the sheet type, sheet separation is impossible by the peeling function described in '173 application, and overlapped feeding may occur.

On the other hand, in an image forming apparatus, sometimes a feed-failure jam occurs, that is, a sheet of paper is not well fed but stopped on the feeding path. If such a feed-failure jam is left unaddressed, it possibly leads to a complicated jam as a paper path obstruction. Therefore, if a feed-failure jam is detected, paper feed should be stopped immediately.

As a typical method of detecting a feed-failure jam, a time from detection of a leading edge to detection of a trailing edge of a sheet at a certain position is measured, and if it exceeds a time corresponding to the sheet length, it is determined that a feed-failure jam has occurred.

According to this method of detecting a feed-failure jam, however, overlapped feeding would be mistaken as a feed-failure jam. If such erroneous detection of feed-failure jam occurs, paper feeding stops. Therefore, it becomes necessary for the user to manually remove the sheets fed in overlapped manner, which is rather troublesome.

Generally, when overlapped feeding occurs, it is considered easier for the user to have the sheets discharged by continuing paper feeding, than to stop feeding.

In view of the foregoing, Japanese Patent Laying-Open No. 2007-206572 (hereinafter referred to as "'572 application") proposes a technique that alleviates burden of removing a sheet of paper, by reducing erroneous detection of feed-failure jam caused by overlapped feeding.

Specifically, on a paper feed path, a sheet passage sensor and a thickness sensor are arranged in this order from the upstream side to the downstream side in the direction of paper feeding. Time from detection of a leading edge to detection of a trailing edge of a sheet by the sheet passage sensor is detected, and whether or not feed-failure jam occurred is determined thereby. Specifically, if the detected time is longer than a normal time used for detecting feed-failure jam, it is determined that a feed-failure jam has occurred. Based on information from thickness sensor, whether or not overlapped feeding has occurred is determined. For instance, if the detected thickness is larger than the thickness of one sheet, it means that sheets are fed in an overlapped manner. If overlapped feeding is detected, paper feeding is continued. If feed-failure jam is detected but overlapped feeding is not detected, operation is controlled such that paper feeding is stopped.

The technique disclosed in '572 application uses a thickness sensor in addition to the sheet passage sensor, in order to reduce erroneous detection of feed-failure jam caused by occurrence of overlapped feeding. The technique, however, has the following problems.

The thickness sensor described in '572 application includes a light source for emitting light to the fed sheet of paper, and a function of measuring the intensity of light transmitted through the sheet that differs depending on the thickness of the sheet, and the sensor is adopted to detect sheet thickness based on the measured light intensity.

The types of paper, however, increase year after year as mentioned above and in order to attain detection accuracy of thickness sensor accordingly, necessary cost would be very high. This makes it difficult to adopt a thickness sensor for detecting overlapped feeding.

Meanwhile, it is among major problems recently in designing paper feeding system, to enable reliable detection of overlapped feeding and feed-failure jam by a combination of ON/OFF of sensors of one same type, that is, sheet passage sensors.

SUMMARY OF THE INVENTION

The present invention was made in view of the technical problems described above, and its object is to provide a sheet feeding apparatus capable of automatically detecting and eliminating feed-failure jam caused by overlapped feeding of sheets based on a combination of ON/OFF of sheet passage sensors, without using a thickness sensor for detecting overlapped feeding, and thereby alleviating burden of removing a sheet by the user, as well as to provide an image forming apparatus with the sheet feeding apparatus.

According to a first aspect, the present invention provides a sheet feeding apparatus, including: first and second sheet sensors provided in order from upstream to downstream sides in a sheet feeding direction on a paper feed path through which sheets of paper are fed one by one by a prescribed paper feeder, each outputting a signal that is on when a sheet is detected and off otherwise; and a plurality of sets of sheet conveyor rollers arranged at a plurality of positions along the paper feed path. Two or more sheets may possibly be fed partially overlapped from the paper feeder to the paper feed path. The plurality of sets of sheet conveyor rollers include a group of upstream rollers on the upstream side than the first sheet sensor, and a group of downstream rollers on the downstream side than the first sheet sensor. The sheet feeding apparatus further includes a roller controller connected to receive output signals of the first and second sheet sensors, and individually controlling the group of upstream rollers and the group of downstream rollers in accordance with a change in value of the output signals. The roller controller includes an overlapped feeding determining device activated in response to start of paper feeding from the paper feeder to the paper feed path, and outputting a determination signal assuming a first value when overlapped feeding of sheets has occurred and a second value otherwise, in response to a change in values of output signals of the first and second sheet sensors, an overlapped feeding eliminating device performing a process for eliminating overlapped feeding by controlling the roller controller, in response to reception of the determination signal of the first value, and a conveyor roller stopping device stopping the sheet conveyor rollers in response to failure of the process for eliminating overlapped feeding by the overlapped feeding eliminating device.

The first and second sensors output a signal that is on if a sheet is detected and off otherwise. The roller controller controls operations of a plurality of sets of sheet conveying rollers in the feed path, in accordance with signals output from the first and second sheet sensors. The overlapped feeding determining device outputs a determination signal of a first value if overlapped feeding of sheets is determined to have occurred, and outputs the determination signal of a second value otherwise. Receiving the determination signal of the first value, the overlapped feeding eliminating device performs an overlapped feeding eliminating process for eliminating overlapped feeding. If the overlapped feeding eliminating process fails, the conveyor roller stopping device stops the sheet conveying rollers. As a result, a sheet feeding apparatus can be provided that is capable of automatically detecting and eliminating feed-failure jam caused by overlapped feeding of sheets based on a combination of ON/OFF of sheet passage sensors, without using a thickness sensor for detecting overlapped feeding, and thereby alleviating burden of removing a sheet by the user.

Preferably, the overlapped feeding eliminating device includes an upstream roller stopping device stopping the paper feeder and the upstream rollers, in response to reception of the determination signal of the first value, and a roller activating device activating the paper feeder and the upstream rollers, in response to a change from on to off of the signal output by the first sheet sensor within a prescribed time period from turning on of the second sheet sensor.

Receiving the determination signal of the first value, the overlapped feeding eliminating device stops the upstream rollers. Therefore, it is unlikely that a new sheet is fed and causes a jam. On the other hand, the sheet at the position of overlapped feeding would be conveyed by the downstream rollers, eliminating overlapped feeding. If the output signal from the first sheet sensor turns from on to off within a prescribed time period, it is supposed that the sheet is fed, and hence, the upstream rollers, which have been stopped, may be activated to resume paper feeding. As a result, it becomes possible to grasp the state of paper feed path and to control feeding simply based on the output signals of sheet sensors.

More preferably, the conveyor roller stopping device includes a downstream roller group stopping device stopping the group of downstream rollers when the prescribed time period passed with the signal output from the first sheet sensor kept on, after the upstream rollers were stopped by the upstream roller stopping device.

When the upstream rollers were stopped by the upstream roller stopping device and thereafter a prescribed time period passed with the signal output from first sheet sensor kept on, it is determined that an attempt to eliminate overlapped feeding has failed and caused a feed-failure jam in the paper paper feed path. In that case, downstream roller stopping device stops the group of downstream rollers, to stop sheet feeding. As a result, paper feed stops completely, and the sheet left on the feed path can be removed manually.

Preferably, the overlapped feeding determining device includes an overlapped feeding occurrence determining device outputting the first determination signal of the first value, when a prescribed time period passed with the output signal from the first sheet sensor kept on, after the output signal from the first sheet sensor changed from off to on.

If the output signal of first sheet sensor turns from off to on, it is highly likely that the sheet is at the position of first sheet sensor. If a prescribed time period passes with the signal output kept on, it is considered that overlapped feeding has occurred and it takes time for the sheets to pass through the first sheet sensor. Therefore, occurrence of the overlapped feeding can be recognized without using a thickness sensor.

Preferably, the roller controller further includes a conveyor roller reactivating device activating both the upstream and downstream rollers for feeding a sheet from the prescribed paper feeder to the paper feed path, in response to turning off of both output signals from the first and second sheet sensors after the downstream roller group was stopped by the downstream roller group stopping device.

When the downstream roller group is stopped by the downstream roller group stopping device, it is possible for the user to remove the sheet left staying on the feed path of the sheet feeding apparatus. When the sheet is removed, outputs of the first and second sheet sensors turn off. Therefore, here, the paper feeding operation can be resumed, and hence, the conveyor roller resetting device activates both the upstream and downstream roller groups. As a result, after the process of removing the sheet left on the path, the sheet feeding operation can be resumed smooth.

Preferably, the overlapped feeding determining device includes a timer activated in response to a change from off to on of the output signal of the first sheet sensor, and a circuit outputting the determination signal that assumes a first value if the output signal of the first sheet sensor is on and a second value if it is off, when a prescribed time is counted by the timer.

Preferably, the downstream roller group stopping device includes a timer activated when the second sheet sensor is turned on, and a device inspecting an output of the first sheet sensor when a prescribed time is counted by the timer and stopping, if the output is on, the downstream roller group.

Preferably, the roller activating device includes a timer activated when the second sheet sensor is turned on, and a device inspecting an output of the first sheet sensor when a prescribed time is counted by the timer and activating, if the output is off, the paper feeder and the upstream rollers.

Preferably, the apparatus includes only a pair of the conveyor rollers between the first and second sheet sensors.

According to a second aspect, the present invention provides an image forming apparatus, including: a sheet feeding apparatus feeding sheets of paper on a paper feed path on which sheets of paper are fed one by one by a prescribed paper feeder; and an image forming unit printing image data on the sheet fed through the paper feed path. The sheet feeding apparatus includes first and second sheet sensors provided in order from upstream to downstream sides in a sheet feeding direction on the paper feed path, each outputting a signal that is on when a sheet is detected and off otherwise; and a plurality of sets of sheet conveyor rollers arranged at a plurality of positions along the paper feed path. Two or more sheets may possibly be fed partially overlapped from the paper feeder to the paper feed path. The plurality of sets of sheet conveyor rollers include a group of upstream rollers on the upstream side than the first sheet sensor, and a group of downstream rollers on the downstream side than the first sheet sensor. The sheet feeding apparatus further includes a roller controller connected to receive output signals of the first and second sheet sensors, and individually controlling the group of upstream rollers and the group of downstream rollers in accordance with a change in value of the output signals. The roller controller includes an overlapped feeding determining device activated in response to start of paper feeding from the paper feeder to the paper feed path, and outputting a determination signal assuming a first value when overlapped feeding of sheets has occurred and a second value otherwise, in response to a change in values of output signals of the first and second sheet sensors, an overlapped feeding eliminating device performing a process for eliminating overlapped feeding by controlling the roller controller, in response to reception of the determination signal of the first value, and a conveyor roller stopping device stopping the sheet conveyor rollers in response to failure of the process for eliminating overlapped feeding by the overlapped feeding eliminating device.

Preferably, the image forming apparatus further includes a discharge device discharging, when two or more sheets are fed in partially overlapped manner to the paper feed path and a preceding sheet is for printing last page of the image data, a sheet following the preceding sheet without performing printing process.

If the preceding one of the sheets fed in the overlapped manner is the last page of image forming process, the succeeding one of the sheets fed in the overlapped manner must be discharged without performing any image forming process. Therefore, if the preceding one of the sheets fed in the overlapped manner is the last page of image forming process, the discharge device discharges the sheet following the preceding sheet without performing image processing.

According to a third aspect, the present invention provides a method of sheet feeding, in a sheet feeding apparatus including first and second sheet sensors provided in order from upstream to downstream sides in a sheet feeding direction on a paper feed path through which sheets of paper are fed one by one by a prescribed paper feeder, each outputting a signal that is on when a sheet is detected and off otherwise, and a plurality of sets of sheet conveyor rollers arranged at a plurality of positions along the paper feed path. Two or more sheets may possibly be fed partially overlapped from the paper feeder to the paper feed path. The plurality of sets of sheet conveyor rollers include a group of upstream rollers on the upstream side than the first sheet sensor, and a group of downstream rollers on the downstream side than the first sheet sensor. The sheet feeding apparatus further includes a roller controller connected to receive output signals of the first and second sheet sensors, and individually controlling the group of upstream rollers and the group of downstream rollers in accordance with a change in value of the output signals. The sheet feeding method includes: the step, started in response to start of paper feeding from the paper feeder to the paper feed path, of outputting a determination signal assuming a first value when overlapped feeding of sheets has occurred and a second value otherwise, in response to a change in values of output signals of the first and second sheet sensors; the step of performing a process for eliminating overlapped feeding by controlling the roller controller, in response to reception of the determination signal of the first value; and the step of stopping the sheet conveyor rollers in response to failure of the process for eliminating overlapped feeding at the step of performing the process for eliminating overlapped feeding.

According to the present invention, it becomes possible to automatically detect an overlapped feeding of sheets based on a combination of ON/OFF of sheet passage sensors and to eliminate the overlapped feeding without using a thickness sensor for detecting the overlapped feeding. Therefore, the burden on the user to remove the sheet can be alleviated.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
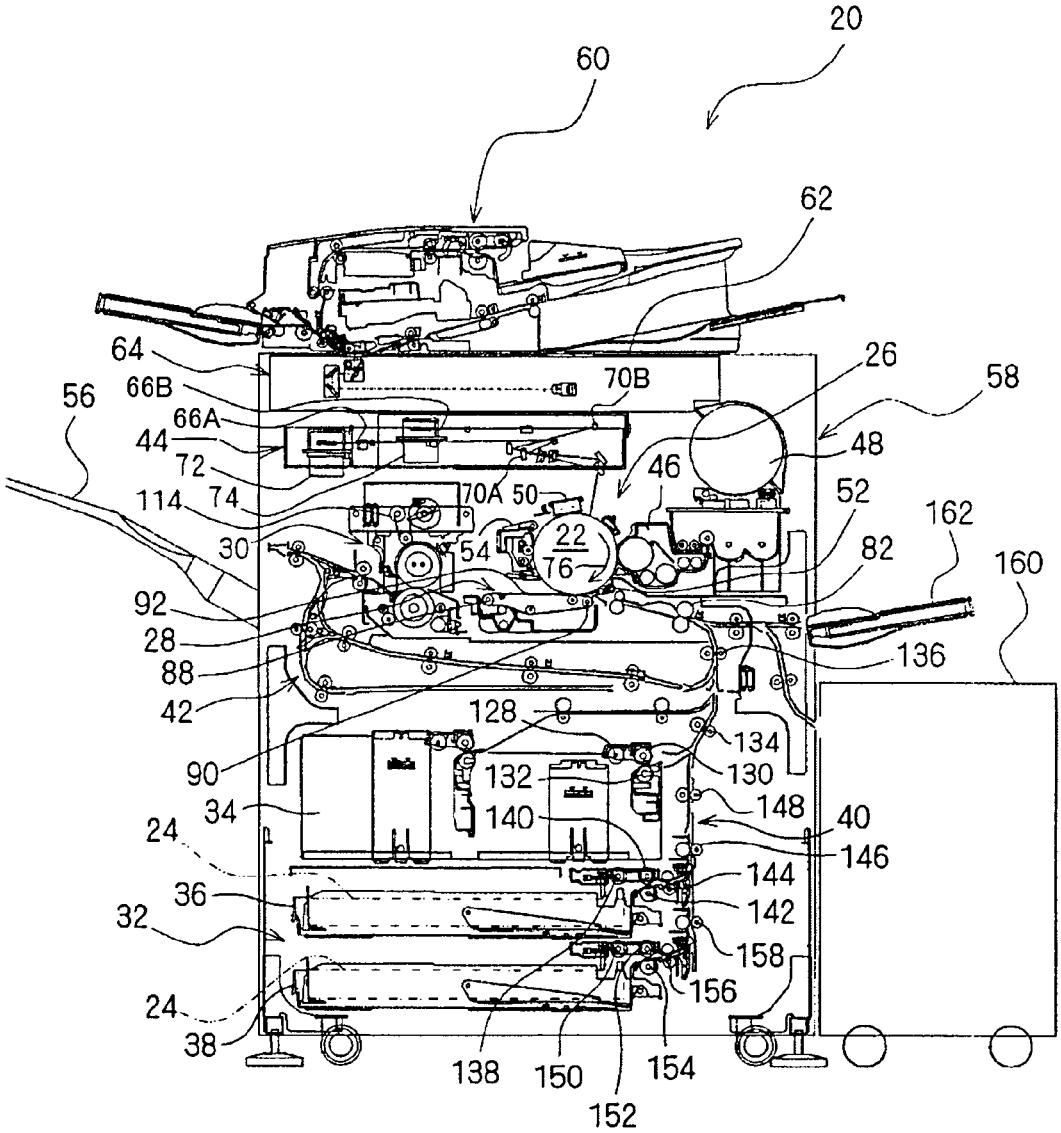
FIG. 1 shows an overall configuration of an image forming apparatus 20 in accordance with an embodiment of the present invention.

In the following description and in the appended drawings, corresponding components are denoted by the same reference characters. Their names and functions are also the same.

<Overall Structure>

Figure 2:
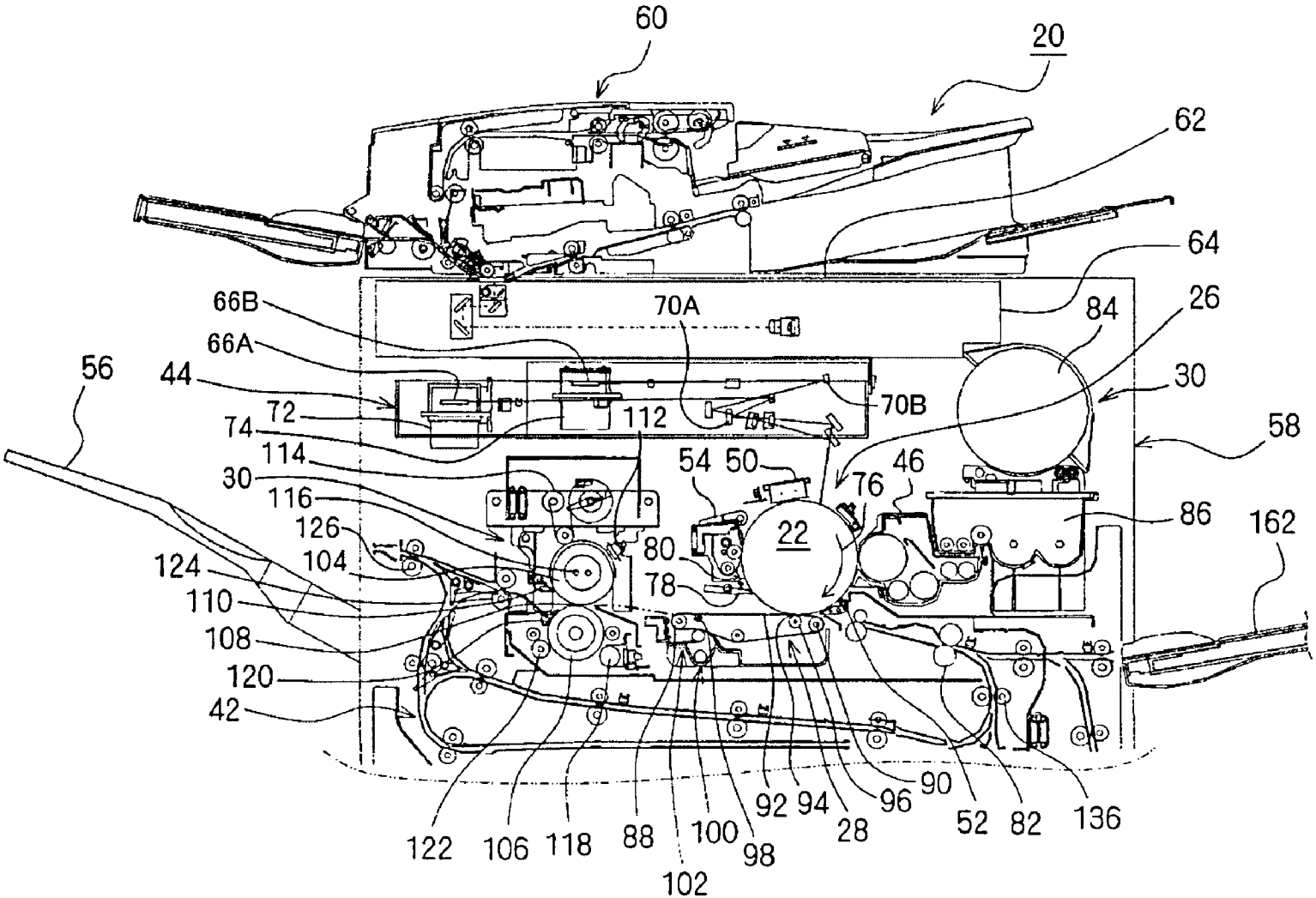
FIG. 2 shows a structure of an upper portion of image forming apparatus 20.

Referring to FIGS. 1 and 2, the image forming apparatus 20 in accordance with the present embodiment is, by way of example, a multifunctional apparatus including copy, printer and facsimile functions, and it outputs image data read by a scanner or the like or image data transmitted from an external device such as a client personal computer (hereinafter referred to as a "client PC") 320 shown in FIG. 4 or the like, by electrophotographic technique. Specifically, an electrostatic latent image is formed on a surface of a photoreceptor drum 22, which is driven to rotate, the formed electrostatic latent image is visualized as a toner image by a two-component developer charged by mixing electric toner with magnetic carrier, and the image is transferred onto a sheet of paper 24 and fixed as a monochrome (single color) image. Therefore, image forming apparatus 20 includes an image forming unit 26 having the photoreceptor drum 22, a transfer mechanism 28 for directly or indirectly transferring the toner image formed on photoreceptor drum 22 to the sheet of paper, and a fixing unit 30 for melting and fixing the not-yet-fixed toner image transferred to the sheet of paper on the sheet of paper.

Further, image forming apparatus 20 includes multi-stage paper feed cassettes 34, 36 and 38 functioning as a sheet containing unit 32 and capable of storing sheets of paper 24, a sheet feeding unit 40 feeding sheet 24 fed from multi-stage paper feed cassette 34, 36 or 38 to image forming unit 26, and a sheet feeder 42 feeding the sheet 24 on which printing has been done at image forming unit 26, to fixing unit 30 for fixing.

As shown in FIG. 1, image forming apparatus 20 mainly includes an apparatus body 58 including an exposure unit 44, a developer 46, a toner supply device 48, photoreceptor drum 22, a charger 50, a neutralizer 52, a photoreceptor drum cleaning unit 54, fixing unit 30, sheet feeder 42, multi-stage paper feed cassettes 34, 36, 38, a discharge tray 56 and a transfer mechanism 28, and an automatic document feeder 60.

On an upper surface of apparatus body 58, a platen 62 of transparent glass for receiving a document is provided. Automatic document feeder 60 is attached to apparatus body 58 to open/close platen 62.

Below the platen 62, a scanner unit 64 is provided for reading image information of the document. Below scanner unit 64, exposure unit 44, developer 46, photoreceptor drum 22, charger 50, neutralizer 52, photoreceptor drum cleaning unit 54, fixing unit 30, sheet feeder 42, discharge tray 56 and transfer mechanism 28 are arranged.

Figure 4:
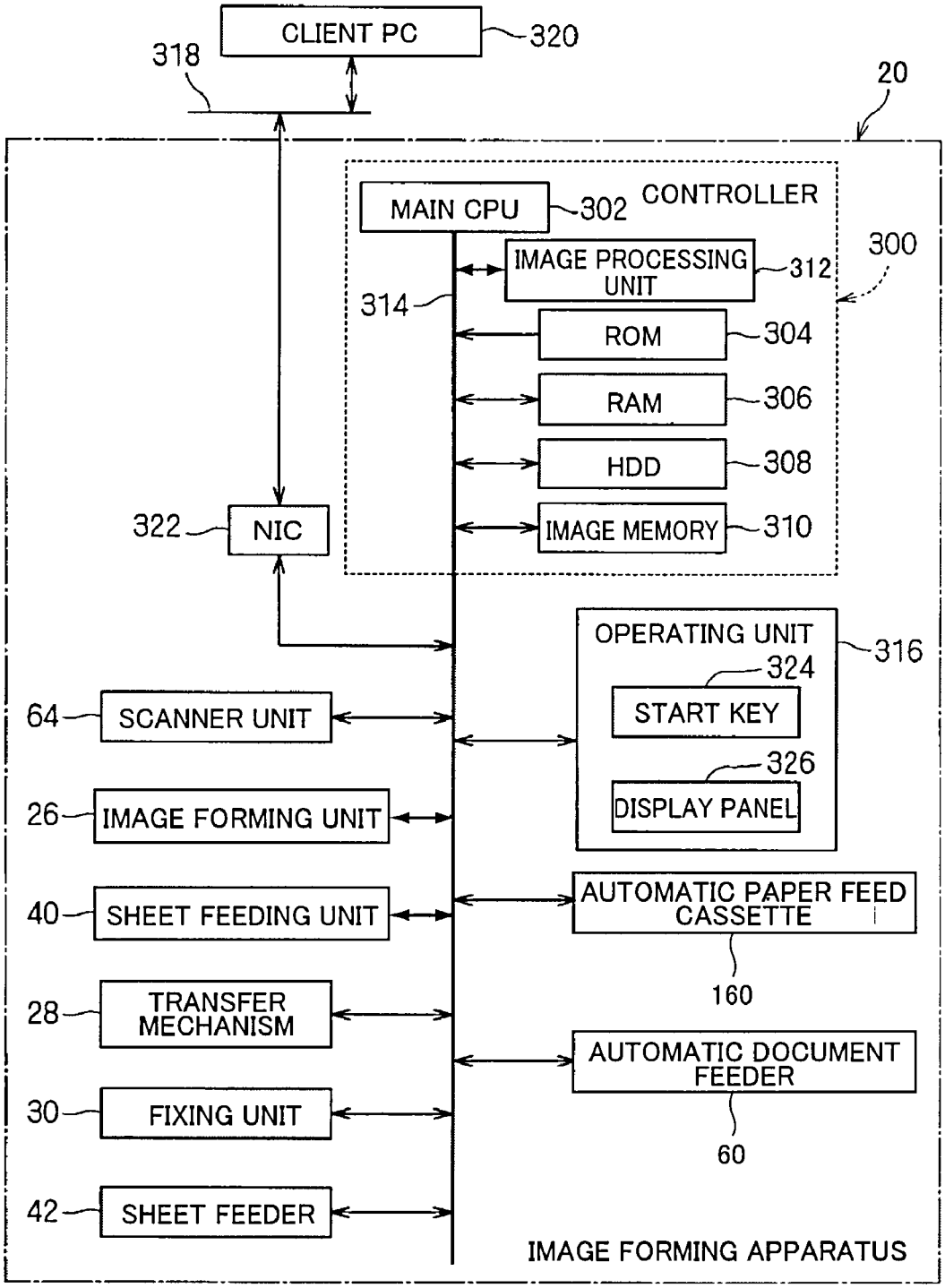
FIG. 4 is a block diagram representing hardware configuration of image forming apparatus 20.

Exposure unit 44 has a function of irradiating a surface of photoreceptor drum 22 charged uniformly by charger 50 with a laser beam in accordance with the image data output from image processing unit 312 shown in FIG. 4 for exposure, and thereby forming an electrostatic latent image in accordance with the image data on the surface of photoreceptor drum 22. Exposure unit 44 is arranged immediately below scanner unit 64 and above photoreceptor drum 22. Exposure unit 44 includes laser scanning units (hereinafter referred to as "LSUs") 72 and 74 with laser emitting units 66A, 66B, and reflection mirrors 70A, 70B. In the present embodiment, for high-speed printing, two-beam technique is adopted, in which a plurality of laser beams are utilized to attain moderate emission timing. Though LSUs 72 and 74 are used in exposure unit 44 in the present embodiment, an array of light emitting elements such as EL (Electro Luminescence) or LED (Light Emitting Diode) write heads, for example, may be used.

Photoreceptor drum 22 is arranged below exposure unit 44 and controlled such that it rotates in a prescribed direction (direction of arrow 76 in the figure) by a driving device, not shown, and controller 300 shown in FIG. 4.

Around photoreceptor drum 22, a sheet separating pawl 78, photoreceptor drum cleaning unit 54, charger 50 as electric field generator, developer 46 and neutralizer 52 are arranged in this order along the direction of rotation of photoreceptor drum 22, with the position at the end of image transfer being a reference, as shown in FIG. 2.

Sheet separating pawl 78 is arranged to be brought into contact with/separated from the outer circumferential surface of photoreceptor drum 22, by a solenoid 80. Sheet separating pawl 78 separates, in a state in contact with the outer circumferential surface of photoreceptor drum 22, the sheet of paper 24 adhering to the surface of photoreceptor drum 22 when the toner image formed on the surface of photoreceptor drum 22 is transferred to the sheet of paper 24. In place of solenoid 80, a driving motor or the like may be used as the device for driving sheet separating pawl 78, or other driving method may be used.

Developer 46 visualizes the electrostatic latent image formed on the surface of photoreceptor drum 22 by black toner. Below developer 46 and upstream side in the paper feeding direction, a register roller 82 is arranged.

A toner supply device 48 is arranged adjacent to developer 46, and it stores toner, discharged from a toner container 84 filled with toner, temporarily in a hopper 86 and then supplies the toner to developer 46.

Charger 50 is arranged above photoreceptor drum 22, near the outer circumferential surface of photoreceptor drum 22, and it uniformly charges the surface of photoreceptor drum 22 to a prescribed potential. Though a non-contact type charger is used as charger 50 in the present embodiment, a contact type charger, such as a roller charger or a brush charger, may be used.

Neutralizer 52 lowers the surface potential of photoreceptor drum 22 so as to facilitate transfer of the toner image formed on the surface of photoreceptor drum 22 to the sheet of paper 24. Though neutralizer having neutralizing electrode is used as neutralizer 52 in the present embodiment, one that utilizes a neutralizing lamp, or other type of neutralizer may be used.

Photoreceptor drum cleaning unit 54 removes and recovers the toner left on the surface of photoreceptor drum 22, after development and transfer of toner image.

As described above, the electrostatic latent image that has been visualized on the surface of photoreceptor drum 22 is transferred to the sheet of paper 24 by applying, from transfer mechanism 28 to the fed sheet of paper 24, electric field of opposite polarity to the charges of the electrostatic latent image. For instance, if the electrostatic latent image has charges of (−) polarity, the polarity applied by transfer mechanism 28 is of (+) polarity.

Transfer mechanism 28 includes a driving roller 88, a driven roller 90, and a transfer belt 92 wound around driving and driven rollers 88 and 90 and other rollers, and formed as a unit including these components. Transfer belt 92 has a prescribed resistance value (in the present embodiment, in the range of $1\times10^{9}$ Ω·cm to $1\times10^{13}$ Ω·cm), and it is arranged below photoreceptor drum 22 such that the surface of transfer belt 92 is in contact with a part of outer circumferential surface of photoreceptor drum 22. In transfer mechanism 28, the sheet of paper 24 is fed pressed against photoreceptor drum 22 by means of transfer belt 92.

Near the portion 94 at which photoreceptor drum 22 and transfer belt 92 are in contact with each other, an elastic conductive roller 96, which has conductivity type different from that of driving and driven rollers 88 and 90 and is capable of applying transfer electric field, is arranged.

Elastic conductive roller 96 is formed of a soft material such as elastic rubber or foamable resin. With elastic conductive roller 96 being elastic, the contact between photoreceptor drum 22 and transfer belt 92 becomes a plane contact of a prescribed width, which is referred to as a transfer nip, rather than a line contact. This improves transfer efficiency of the toner image to the fed sheet of paper 24.

Further, on the downstream side of paper feeding direction than the transfer area of transfer belt 92, a neutralizing roller 98 is arranged, on the back side of transfer belt 92, for neutralizing the electric field applied to the fed sheet of paper 24 at the transfer area, to enable smooth feeding of the sheet of paper 24 to the next step.

As shown in FIG. 2, in transfer mechanism 28, a transfer belt cleaning unit 100 for removing smudge of toner left on the surface of transfer belt 92, and a plurality of neutralizing mechanisms 102 for neutralizing transfer belt 92 are arranged. The neutralizing method applied to neutralizing mechanism 102 may be a method of grounding through the apparatus, or a method of positively applying an electric field having opposite polarity to the transfer electric field.

The electrostatic latent image transferred to the sheet at transfer mechanism 28 is fed to fixing unit 30 and pressurized and heated, whereby the not-yet-fixed toner is melt and fixed on the sheet of paper 24.

In fixing unit 30, the not-yet-fixed toner on the fed sheet of paper 24 is heated and melt by a heating roller 104 at a pressure-contact portion 108 generally referred to as a fixing nip, where heating roller 104 and a pressurizing roller 106 are in pressure contact with each other, and by the function of pressure contact between heating roller 104 and pressurizing roller 106, the melt toner is fixed on the sheet of paper 24.

Near the outer circumferential surface of heating roller 104, a paper separation pawl 110, a thermister 112 and a fixing roller cleaning unit 114 for cleaning the outer circumferential surface of heating roller 104 are arranged. On the inner circumferential portion, a heat source 116 is provided, to heat the surface of heating roller 104 to a prescribed temperature (set fixing temperature: approximately 160° C. to approximately 200° C.).

On pressurizing roller 106, pressurizing members 118 are arranged to enable pressure contact of roller 106 to heating roller 104 with a prescribed pressure, and near the outer circumferential surface of pressurizing roller 106, a paper separation pawl 120 and a pressurizing roller surface cleaning member 122 are arranged, as in the vicinity of heating roller 104.

Near the fixing unit 30, a conveyor roller 124 is provided, for feeding the sheet of paper 24 through fixing unit 30. On the downstream side in the paper feeding direction of conveyor roller 124, a discharge roller 126 is provided for discharging the sheet of paper 24 to discharge tray 56.

Multi-stage paper feed cassettes 34, 36 and 38 are to store a plurality of sheets of paper 24 of mutually different sizes, as shown in FIG. 1, and arranged below image forming unit 26.

Sheet feeding unit 40 includes three paper feeding systems for feeding the sheet of paper 24 from cassettes 34, 36 and 38 to a paper feed path leading to image forming unit 26, and three sheet feeding systems for feeding sheet of paper 24 from each of the paper feeding systems through the paper feed path to image forming unit 26.

The first paper feeding system includes a pick-up roller 128 for feeding the sheets of paper 24 in the uppermost, first paper feed cassette 34 one by one to the paper feed path, and a paper feed roller 130 and a separation roller 132 forming a vertical pair and serving as retard rollers. The sheets of paper 24 stacked in cassette 34 are picked-up one by one from the uppermost layer, and fed to the first sheet feeding system on the paper feed path, by the rotations of rollers 128, 130 and 132. Pick-up roller 128, paper feed roller 130 and separation roller 132 are arranged at an end portion of paper discharging side of first cassette 34. The sheet of paper 24 fed from the inside of first cassette 34 to the first sheet feeding system by the operations of rollers 128, 130 and 132 is transmitted to a register roller 82 positioned at the terminal end in the feeding direction of paper feed path, by the rotations of two sets of conveyor roller pairs 134 and 136 of the first sheet feeding system.

The second paper feeding system includes a pick-up roller 138 for feeding the sheets of paper 24 in the middle, second paper feed cassette 36 one by one to the paper feed path, and a paper feed roller 140 and a separation roller 142 forming a vertical pair and serving as retard rollers. The sheets of paper 24 stacked in cassette 36 is picked-up one by one from the uppermost layer, and fed to the second sheet feeding system on the paper feed path, by the rotations of rollers 138, 140 and 142. Pick-up roller 138, paper feed roller 140 and separation roller 142 are arranged at an end portion of paper discharging side of second cassette 36. The sheet of paper 24 fed from the inside of second cassette 36 to the second sheet feeding system by the operations of rollers 138, 140 and 142 is transmitted to a register roller 82 positioned at the terminal end in the feeding direction of paper feed path, by the rotations of five sets of conveyor rollers 144, 146, 148, 134 and 136 of the second sheet feeding system.

The third paper feeding system includes a pick-up roller 150 for feeding the sheets of paper 24 in the lowermost, third paper feed cassette 38 one by one to the paper feed path, and a paper feed roller 152 and a separation roller 154 forming a vertical pair and serving as retard rollers. The sheets of paper 24 stacked in cassette 38 is picked-up one by one from the uppermost layer, and fed to the third sheet feeding system on the paper feed path, by the rotations of rollers 150, 152 and 154. Pick-up roller 150, paper feed roller 152 and separation roller 154 are arranged at an end portion of paper discharging side of third cassette 38. The sheet of paper 24 fed from the inside of third cassette 38 to the third sheet feeding system by the operations of rollers 150, 152 and 154 is transmitted to a register roller 82 positioned at the terminal end in the feeding direction of paper feed path, by the rotations of six sets of conveyor rollers 156, 158, 146, 148, 134 and 136 of the third sheet feeding system.

Figure 3:
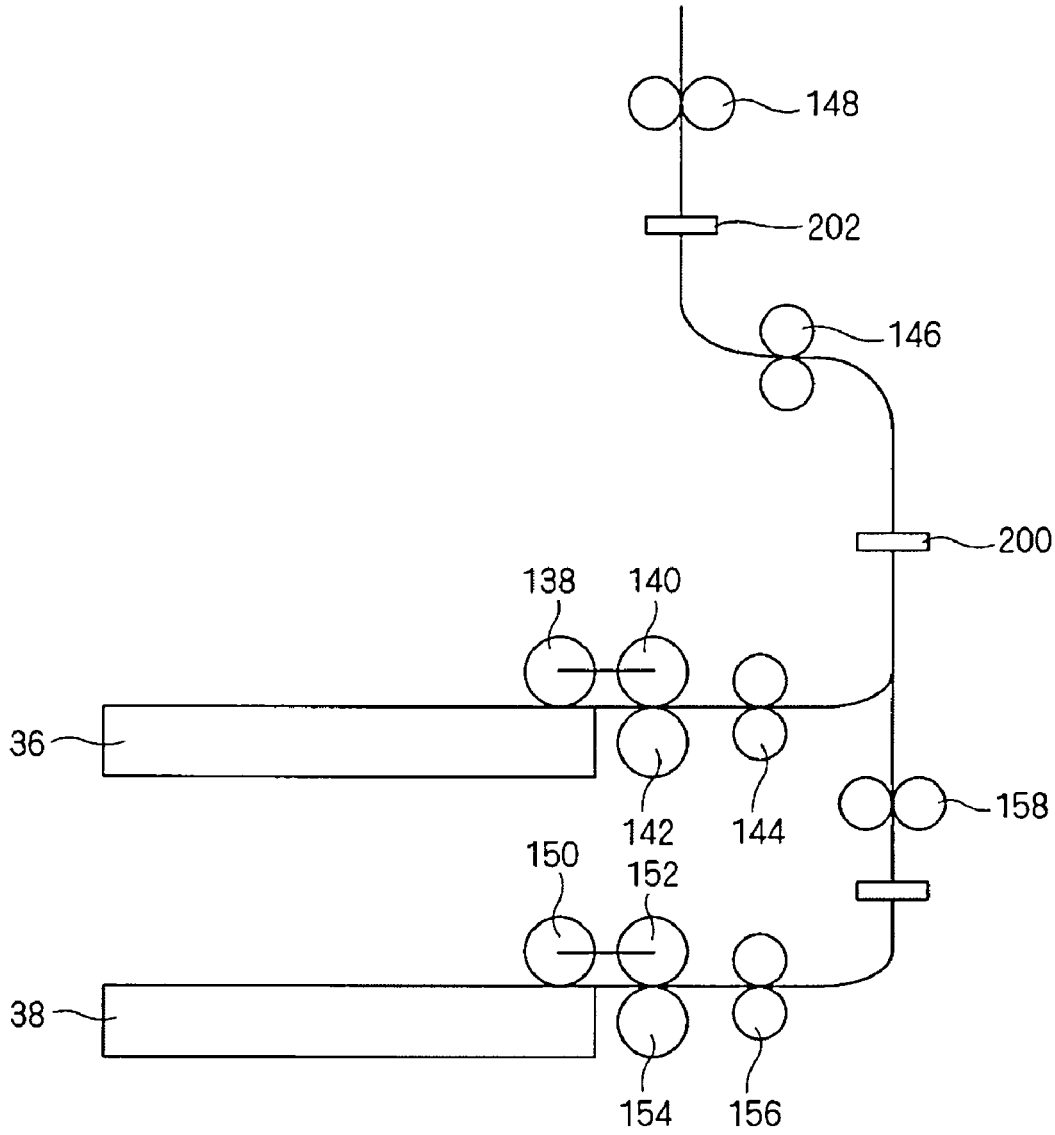
FIG. 3 schematically shows structures of main portions of a second sheet feeding system related to a second paper feed cassette and a third sheet feeding system related to a third paper feed cassette.

Referring to FIG. 3, on the paper feed path shared by the second sheet feeding system related to the second paper feed cassette 36 and the third sheet feeding system related to the third paper feed cassette 38, a first sheet passage sensor 200 and a second sheet passage sensor 202 are arranged in this order from the upstream side to the downstream side in the sheet feeding direction, with conveyor rollers 146 positioned therebetween. As sheet passage sensors 200 and 202, a sensor that can detect passage of sheet of paper 24 in a non-contact manner, such as an optical sensor or an ultrasonic sensor, may be used.

Again referring to FIGS. 1 and 2, register roller 82 has its operation controlled by a driving device, not shown, and controller 300 shown in FIG. 4, such that a sheet of paper 24 fed from each of cassettes 34, 36 and 38 is fed between photoreceptor drum 22 and transfer belt 92 with tip end of the sheet aligned with the toner image formed on the surface of photoreceptor drum 22.

To one side surface of apparatus body 58 (on the right side surface in FIG. 1), an automatic paper feeding cassette 160 is connected, which is capable of storing sheets of paper of different types in large volume. Above the automatic paper feeding cassette 160, a manual feed tray 162 is provided mainly for handling sheets of paper of irregular size. From automatic paper feeding cassette 160 and manual feed tray 162 also, sheet of paper 24 is fed to image forming unit 26 through the paper feed path.

Paper discharge tray 56 is arranged opposite to the side where the manual feed tray 162 is provided. Image forming apparatus 20 may have a post processing device for stapling or punching of the discharged sheets, a multi-stage discharge tray or the like arranged as an optional component, in place of paper discharge tray 56.

Sheet feeder 42 is arranged between photoreceptor drum 22 and multi-stage paper feed cassettes 34, 36 and 38 described above. Sheet feeder 42 is provided with the paper feed path, a branching pawl and the like. Sheet feeder 42 has functions of feeding sheets of paper 24 supplied from cassettes 34, 36 and 38 one by one to transfer mechanism 28, feeding the sheet of paper 24 on which the toner image is transferred from photoreceptor drum 22 by transfer mechanism 28 to fixing unit 30, and after the toner image is transferred by fixing unit 30, feeding the sheet of paper 24 in accordance with a designated paper discharge mode.

In image forming apparatus 20, a one-sided printing mode and a two-sided printing mode are set in advance as the discharge modes. In the image forming apparatus 20, in the one-sided printing mode, it is possible to selectively set either a face-up discharging in which the sheet of paper is discharged with the printed side facing upward or a face-down discharging in which the sheet of paper is discharged with the printed side facing downward.

<Hardware Configuration>

Referring to FIG. 4, image forming apparatus 20 includes a controller 300 for overall control of image forming apparatus 20.

Controller 300 is substantially a computer, including a main CPU (Central Processing Unit) 302, an ROM (Read Only Memory) 304, an RAM (Random Access Memory) 306, an HDD (Hard Disk Drive) 308, an image memory 310 and an image processing unit 312.

A common bus line 314 is connected to main CPU 302 and, to the common bus line 314, ROM 304, RAM 306, HDD 308, image memory 310 and image processing unit 312 are connected.

Figure 5:
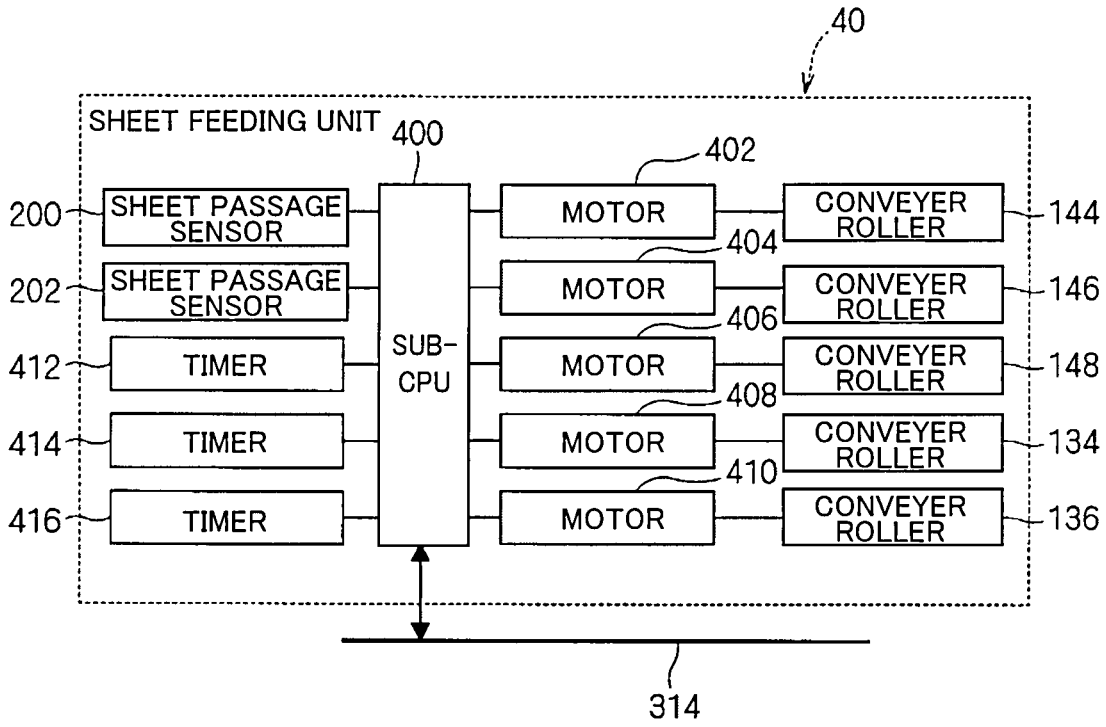
FIG. 5 is a block diagram showing an electric structure related to a second sheet feeding system related to a second paper feed cassette 36 of a sheet feeding unit 40.

Main CPU 302 realizes the function of sheet feeding unit 40 shown in FIG. 5, by executing a computer program for realizing the sheet feeding process in accordance with the present embodiment. The program to be executed by main CPU 302 is stored in ROM 304 or HDD 308.

The program stored in ROM 304 or HDD 308 is read from ROM 304 or HDD 308 at the time of execution and stored in RAM 306. The program is read from an address in RAM 306 indicated by a register functioning as a program counter in main CPU 302, and interpreted and executed by main CPU 302. Data necessary for execution are read from a register in main CPU 302, RAM 306 or HDD 308 at an address designated by the instruction. Similarly, the result of execution is stored in the register in main CPU 302, RAM 306 or HDD 308 at an address designated by the instruction.

To common bus line 314, connected are image forming unit 26, transfer mechanism 28, fixing unit 30, sheet feeding unit 40, sheet feeder 42, automatic document feeder 60, scanner unit 64, automatic paper feeding cassette 160, operating unit 316 of image forming apparatus 20, and an NIC (Network Interface Card) 322 serving as an interface to client PC 320 or the like as an external device through a LAN (Local Area Network) line 318. Main CPU 302 controls image forming unit 26, transfer mechanism 28, fixing unit 30, sheet feeding unit 40, sheet feeder 42, automatic document feeder 60, scanner unit 64, automatic paper feeding cassette 160 and NIC 322, causing these components to execute desired operations such as document reading, document output, feeding and discharge of sheets and communication with an external device such as client PC 320, and stores data in or reads data from RAM 306, HDD 308 and image memory 310.

Operating unit 316 is provided on a front surface of apparatus body 58. Operating unit 316 is provided with a start key 324, a display panel 326 and the like.

The paper feed program in accordance with the present embodiment is transmitted from other device to controller 300 substantially functioning as a computer, through LAN line 318 and NIC 322, and stored in ROM 304 or HDD 308.

<Electrical Structure of Sheet Feeding Unit 40>

Referring to FIG. 5, sheet feeding unit 40 includes a sub-CPU 400 as a control nerve center of control of the sheet feeding unit 40.

Sub-CPU 400 is connected to common bus line 314 and transmits/receives various data and the like to/from main CPU 302 shown in FIG. 4, through common bus line 314. Sub-CPU 400 is connected to motors 402, 404, 406, 408 and 410 as driving sources of five sets of conveyor rollers 144, 146, 148, 134 and 136 forming the second sheet feeding system, sheet passage sensors 200 and 202, and first, second and third timers 412, 414 and 416.

To sub-CPU 400, sensing outputs of sheet passage sensors 200 and 202, and timer outputs (time count values) of timers 412, 414 and 416 are applied. Based on the input sensing outputs from sheet passage sensors 202 and 204 and timer outputs from timers 412, 414 and 416, sub-CPU 400 controls driving of motors 402, 404, 406, 408 and 410.

In the present embodiment, sheet feeding unit 40 and controller 300 function as the sheet feeding apparatus of the present invention.

<Software Configuration>

In the image forming apparatus 20, even when a plurality of sheets of paper 24 are fed continuously to the paper feed path and the first sheet passage sensor 200 is turned ON by the preceding and succeeding sheets, the first process for continuing sheet feeding based on a determination of overlapped feeding is executed, if a leading edge portion of the preceding sheet has turned ON the second sheet passage sensor 202. If the states of first and second sheet passage sensors 201 and 202 are not changed even after the execution of the first process, it is determined that a feed-failure jam has occurred, and the program executes a second process for stopping sheet feeding. More specifically, the program executes the first process while driving of the conveyor rollers on the upstream side in the sheet feeding direction than the first sheet passage sensor 200 is stopped.

Such a program is stored in RAM 306 or HDD 308 of controller 300, and it realizes various functions of image forming apparatus 20 as will be described in the following. These functions are realized by main CPU 302 in controller 300 described above, which is substantially a computer, and sub-CPU 400 in sheet feeding unit 40, executing the program.

In the flowchart representing the program structure of the main routine for realizing the sheet feeding function of image forming apparatus 20, a control flow is shown assuming that sheets of paper 24 are continuously fed to the paper feed path from the second paper feed cassette 36 and a print job remains to be done on last two sheets. Therefore, in the following, of the two sheets on which print job is to be done, the sheet that is fed first will be referred to as the "first sheet" and the sheet that is fed later will be referred to as the "second sheet."

In the present image forming apparatus 20, receiving an ON operation signal of a start key 324 or receiving a print start signal from an external device such as client PC 320, main CPU 302 controls driving of image forming unit 26, transfer mechanism 28, fixing unit 30, sheet feeder 42, scanner unit 64 and sheet feeding unit 40, based on the signal.

Figure 6:
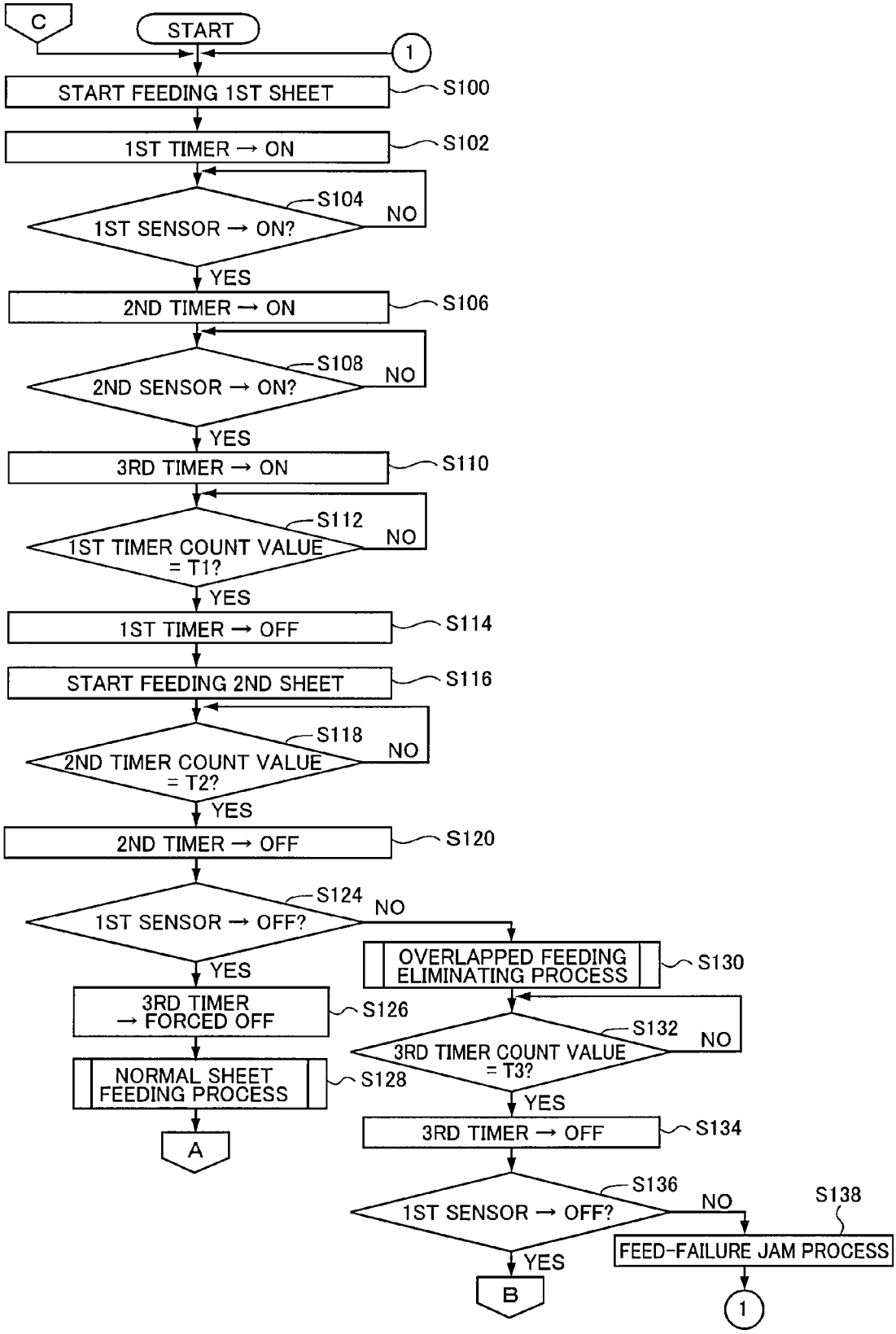
FIG. 6 is a flowchart of a program structure of a main routine realizing the sheet feeding function of image forming apparatus 20.

Referring to FIG. 6, main CPU 302 transmits a sheet feeding command to sub-CPU 400, and through sub-CPU 400, causes operations of pick-up roller 138, paper feed roller 140 and separation roller 142, whereby the operation of feeding the first sheet from the second paper feed cassette 36 starts (step S100).

When the operation of feeding the first sheet starts, sub-CPU 400 turns ON the first timer 412, and waits for the first sheet passage sensor 200 being turned ON by the first sheet (steps S102 and S104).

When the first sheet passage sensor 200 is turned ON by the first sheet, sub-CPU 400 turns ON the second timer 414, and waits for the second sheet passage sensor 202 being turned ON by the first sheet (steps S106 and S108).

When the second sheet passage sensor 202 is turned ON by the first sheet, sub-CPU 400 turns ON the third timer 416, and waits until a count value of first timer 412 attains to T1 (steps S110 and S112).

When the count value of first timer 412 attains to T1, sub-CPU 400 turns OFF the first timer 412 (step S114). At this time, sub-CPU 400 notifies main CPU 302 that the first and second sheet passage sensors 200 and 202 are both turned ON by the first sheet in a time period from when timer 412 was turned ON until the timer reached the time count value T1.

Then, main CPU 302 operates pick-up roller 138, paper feed roller 140 and separation roller 142 through sub-CPU 400, whereby the operation of feeding the second sheet from the second paper feed cassette 36 starts (step S116).

When the operation of feeding the second sheet starts, sub-CPU 400 waits for the count value of second timer 414 attaining to T2, and when the time count value attains to T2, it turns OFF the second timer 414 (steps S118 and S120). At this time, sub-CPU 400 determines whether or not the first sheet passage sensor 200 made a transition from ON to OFF (step S124). The control flow branches depending on the result of determination.

If the first sheet passage sensor 200 has made the transition from ON to OFF at step S124, sub-CPU 400 determines that the first and second sheets are fed not overlapped with each other, or the sheets are fed in a normal manner, and forces OFF the third timer 416 and performs a normal sheet feeding process (steps S126 and S128). When the normal sheet feeding process ends, the control proceeds to step S200 shown in FIG. 7.

Now, the normal sheet feeding process will be described.

Figure 9:
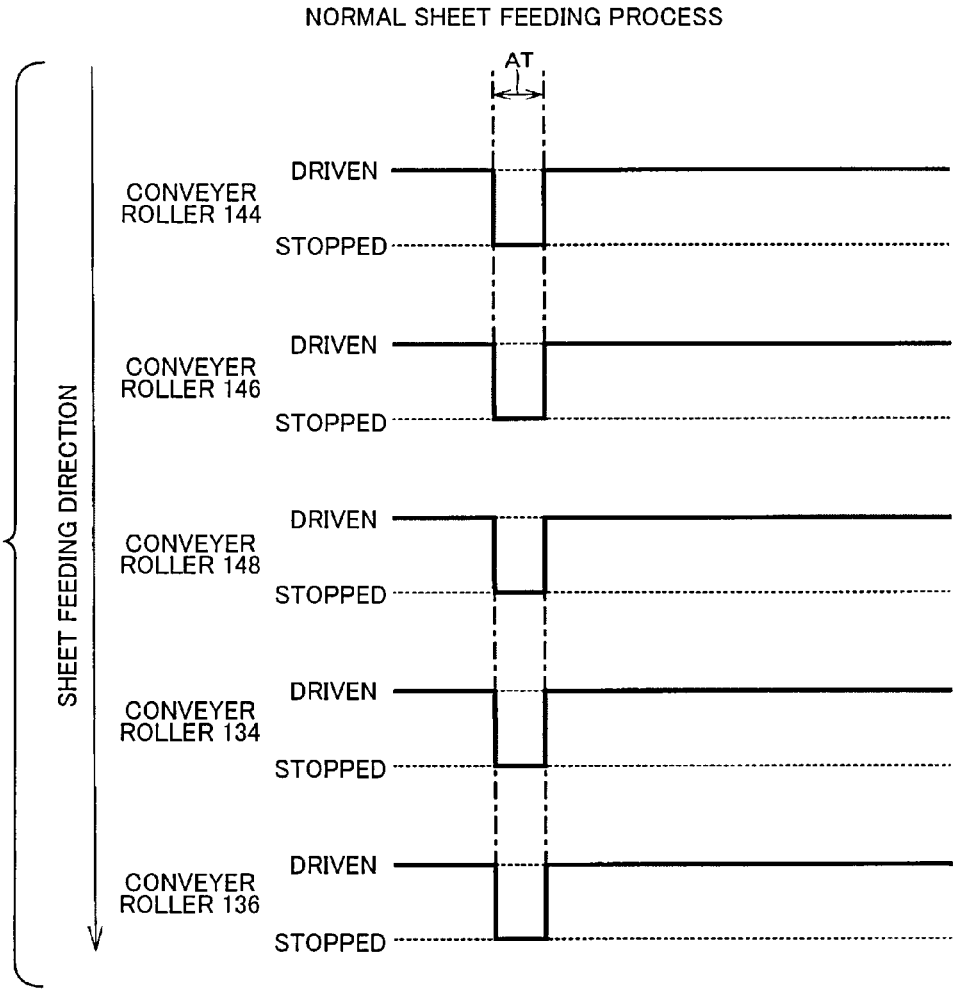
FIG. 9 is a time chart showing a program structure of a subroutine realizing a normal sheet feeding function.

Referring to FIG. 9, for executing the normal sheet feeding process, until after the lapse of an idle time AT, sub-CPU 400 turns OFF motors 402, 404, 406, 408 and 410 and temporarily stops driving of all conveyor rollers 144, 146, 148, 134 and 136 of the second sheet feeding system related to the second paper feed cassette 36, in order to effect print registration of sheets before register roller 82. After the lapse of idle time AT, motors 402, 404, 406, 408 and 410 are turned ON and all conveyor rollers 144, 146, 148, 134 and 136 are driven again.

Again referring to FIG. 6, at step S124, if the first sheet passage sensor 200 has not made a transition from ON to OFF, sub-CPU 400 determines that the first and second sheets are fed in the overlapped manner, and performs a sheet feeding process to eliminate overlapped feeding (step S130). At the end of sheet feeding process to eliminate overlapped feeding, control proceeds to step S132.

The sheet feeding process to eliminate overlapped feeding (overlapped feeding eliminating process) will be described.

Figure 10:
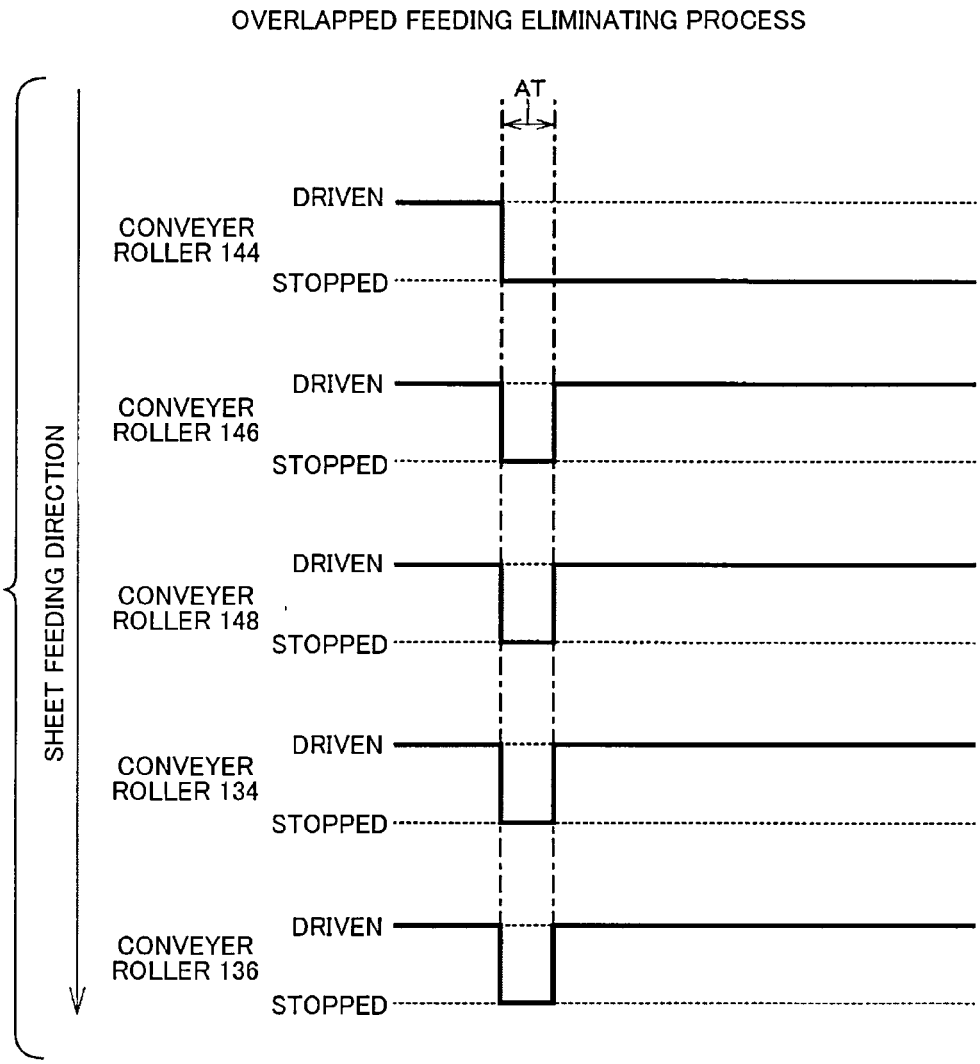
FIG. 10 is a time chart showing a program structure of a subroutine realizing overlapped feeding eliminating function.

Referring to FIG. 10, for executing the sheet feeding process to eliminate overlapped feeding until after the lapse of an idle time AT, sub-CPU 400 turns OFF motors 402, 404, 406, 408 and 410 and temporarily stops driving of all conveyor rollers 144, 146, 148, 134 and 136 of the second sheet feeding system related to the second paper feed cassette 36, in order to effect print registration of sheets before register roller 82. After the lapse of idle time AT, motors 404, 406, 408 and 410 are turned ON while the conveyor rollers 144 on the upstream side in the sheet feeding direction of first sheet passage sensor 200 (closer to the second paper feed cassette than the first sheet passage sensor 200) are kept stopped, and remaining conveyor rollers 146, 148, 134 and 136 are driven again.

Again referring to FIG. 6, when the sheet feeding process to eliminate overlapped feeding ends and control proceeds to step S132, sub-CPU 400 waits for the count value of third timer 416 to attain to T3, and when the time count value attains to T3, turns OFF the third timer 416 (step S134). At this time, sub-CPU 400 determines whether or not the first sheet passage sensor 200 has made a transition from ON to OFF (step S136). The control flow branches depending on the result of determination.

Figure 8:
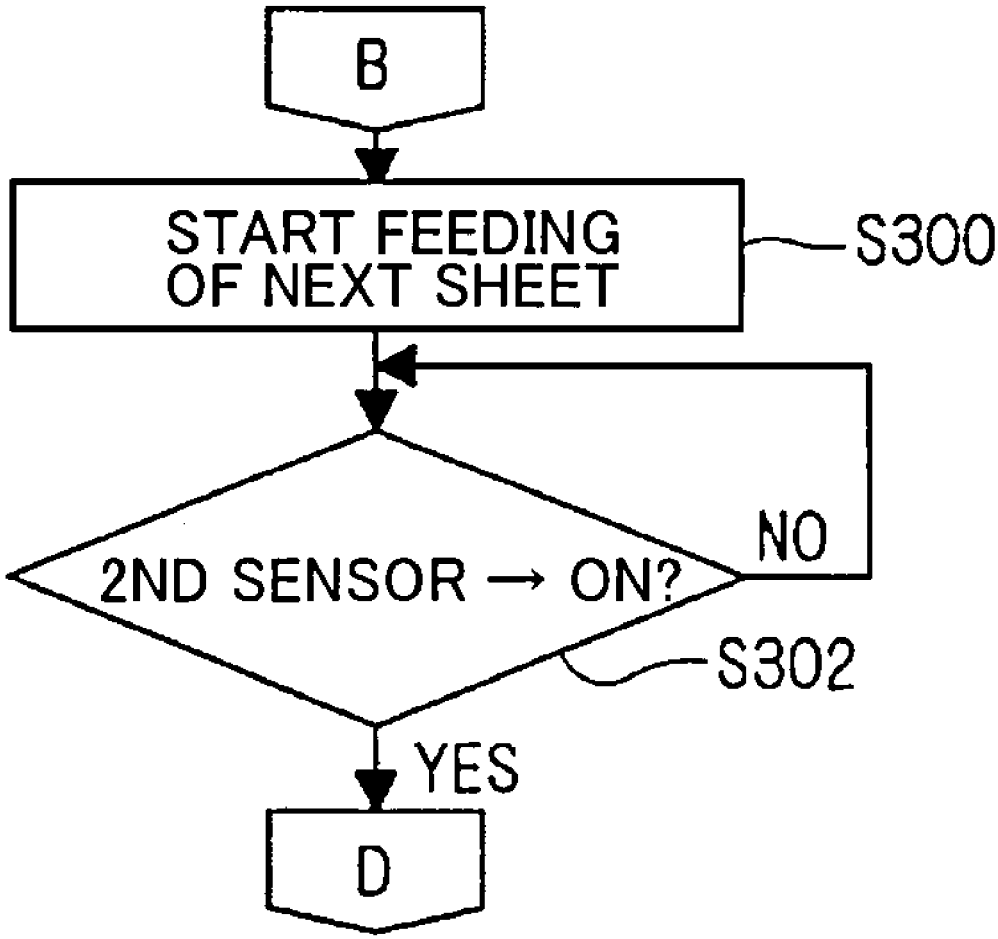
FIG. 8 is a flowchart of a program structure of a main routine realizing the sheet feeding function of image forming apparatus 20, showing processes following step S136 of FIG. 6.

At step S136, if the first sheet passage sensor 200 has made a transition from ON to OFF, sub-CPU 400 determines that the first and second sheets have been separated and overlapped feeding is eliminated, and control proceeds to step S300 shown in FIG. 8. On the contrary, if the first sheet passage sensor 200 has not made a transition from ON to OFF, sub-CPU 400 determines that a feed-failure jam has occurred and performs a feed-failure jam processing, in which the image forming apparatus 20 is stopped (step S138). If the feed-failure jam is eliminated by a manual operation by the user, control resumes from step S100.

Figure 7:
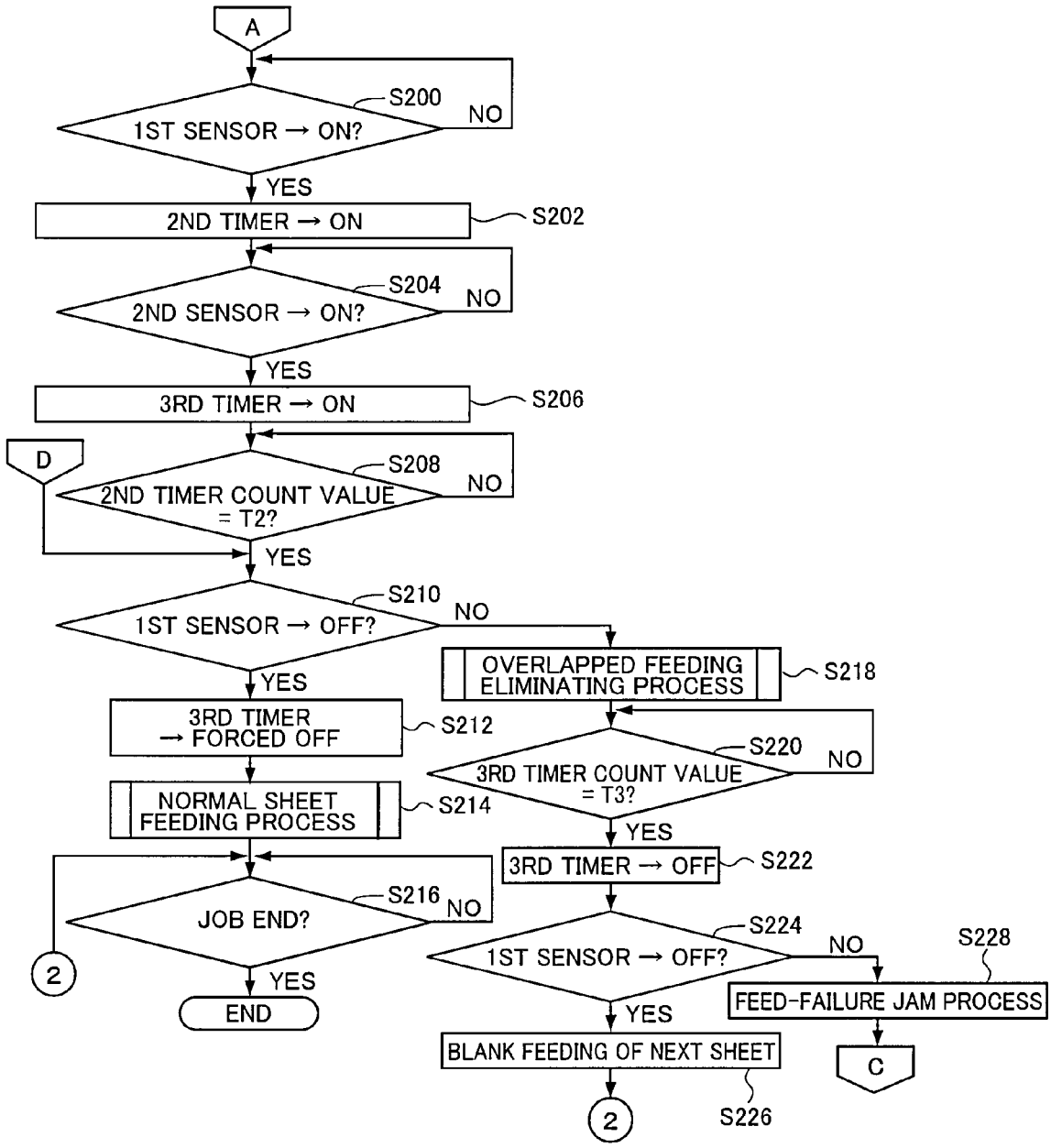
FIG. 7 is a flowchart of a program structure of a main routine realizing the sheet feeding function of image forming apparatus 20, showing processes following step S128 of FIG. 6.

Referring to FIG. 7, when the normal sheet feeding process ends and control proceeds to step S200, sub-CPU 400 turns on the second timer 414 using turning ON of the first sheet passage sensor 200 by the second sheet as a trigger (step S202).

Thereafter, when the second sheet passage sensor 202 is turned ON by the second sheet, using this as a trigger, sub-CPU 400 turns ON the third timer 416 (steps S204 and S206).

When the third timer 416 is turned ON, sub-CPU 400 determines whether the first sheet passage sensor 200 has made a transition from ON to OFF, on condition that the second timer count value has attained to T2 (steps S208 and S210). The control flow branches depending on the result of determination.

At step S210, if the first sheet passage sensor 200 has made a transition from ON to OFF, sub-CPU 400 determines it is a normal sheet feeding state, forces OFF the third timer 416 and performs a normal sheet feeding process similar to step S128 of FIG. 6 described above (steps S212 and S214). Thereafter, when the print job ends at step S216, sub-CPU 400 ends the present program.

If the first sheet passage sensor 200 has not made a transition from ON to OFF at step S210, sub-CPU 400 determines that the second sheet and the following sheet are fed in the overlapped manner, and performs the sheet feeding process to eliminate overlapping similar to that of step S130 of FIG. 6 (step S218).

When the sheet feeding process to eliminate overlapped feeding ends, sub-CPU 400 turns OFF the third timer 416, using count value of third timer 416 attaining to T3 as a trigger (steps S220 and S222). At this time, sub-CPU 400 determines whether or not the first sheet passage sensor 200 has made a transition from ON to OFF (step S224). The control flow branches depending on the result of determination.

At step S224, if the first sheet passage sensor 200 has made a transition from ON to OFF, sub-CPU 400 determines that the second sheet and the following sheet have been separated and overlapped feeding is eliminated, and performs a process of blank-feeding the next sheet (step S226). At this time of blank-feeding, printing is not done on the following sheet, and the sheet is fed as a blank sheet. Thereafter, control proceeds to step S216, and waits for the end of job. On the contrary, if the first sheet passage sensor 200 has not made a transition from ON to OFF, sub-CPU 400 determines that a feed-failure jam has occurred, and performs a feed-failure jam processing, in which the image forming apparatus 20 is stopped (step S228). If the feed-failure jam is eliminated, control resumes from step S100.

Referring to FIG. 8, if it is determined at step S136 of FIG. 6 that the first and second sheets are separated and the overlapped feeding is eliminated and control proceeds to step S300, sub-CPU 400 starts feeding of the next sheet, and waits for the second sheet passage sensor 202 to be turned ON by the second sheet (step S302).

If the second sheet passage sensor 202 is turned ON by the second sheet, control proceeds to step S210 of FIG. 7, and the process steps following step S210 are executed.

<Operation>

Figure 11:
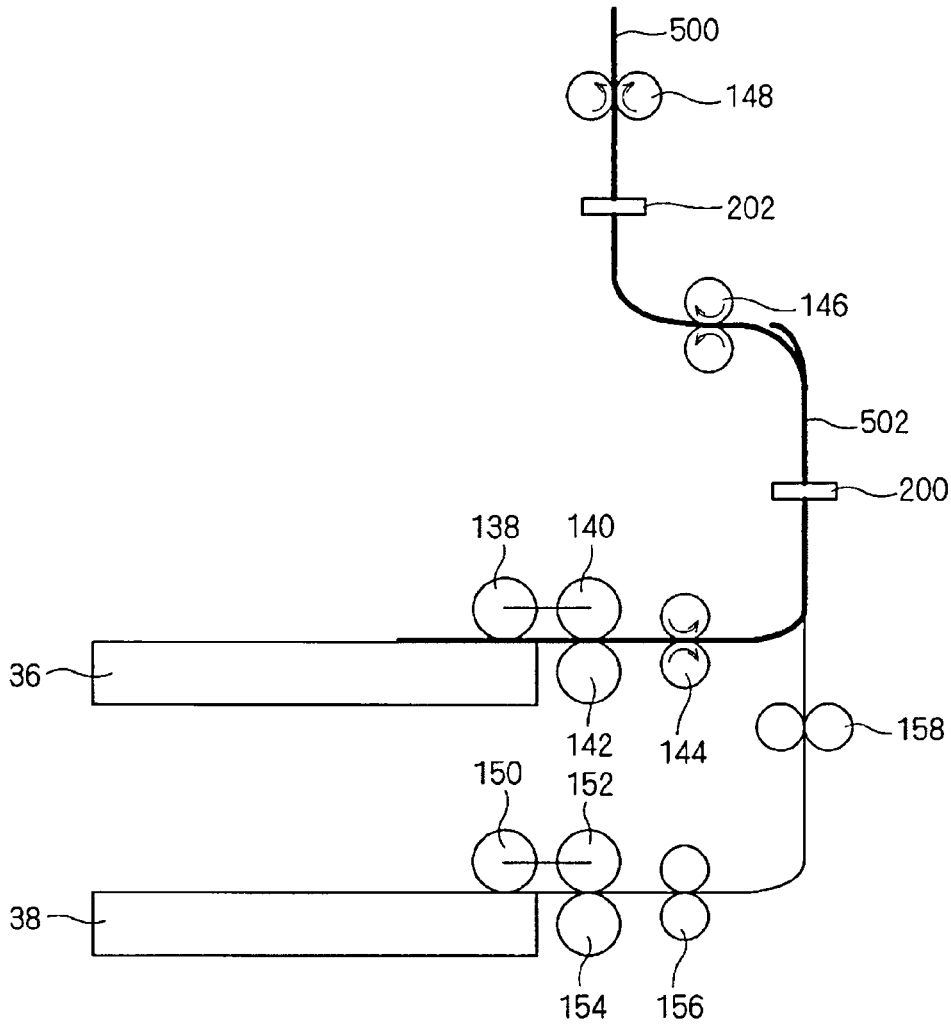
FIG. 11 schematically shows a state when overlapped feeding occurred.
Figure 12:
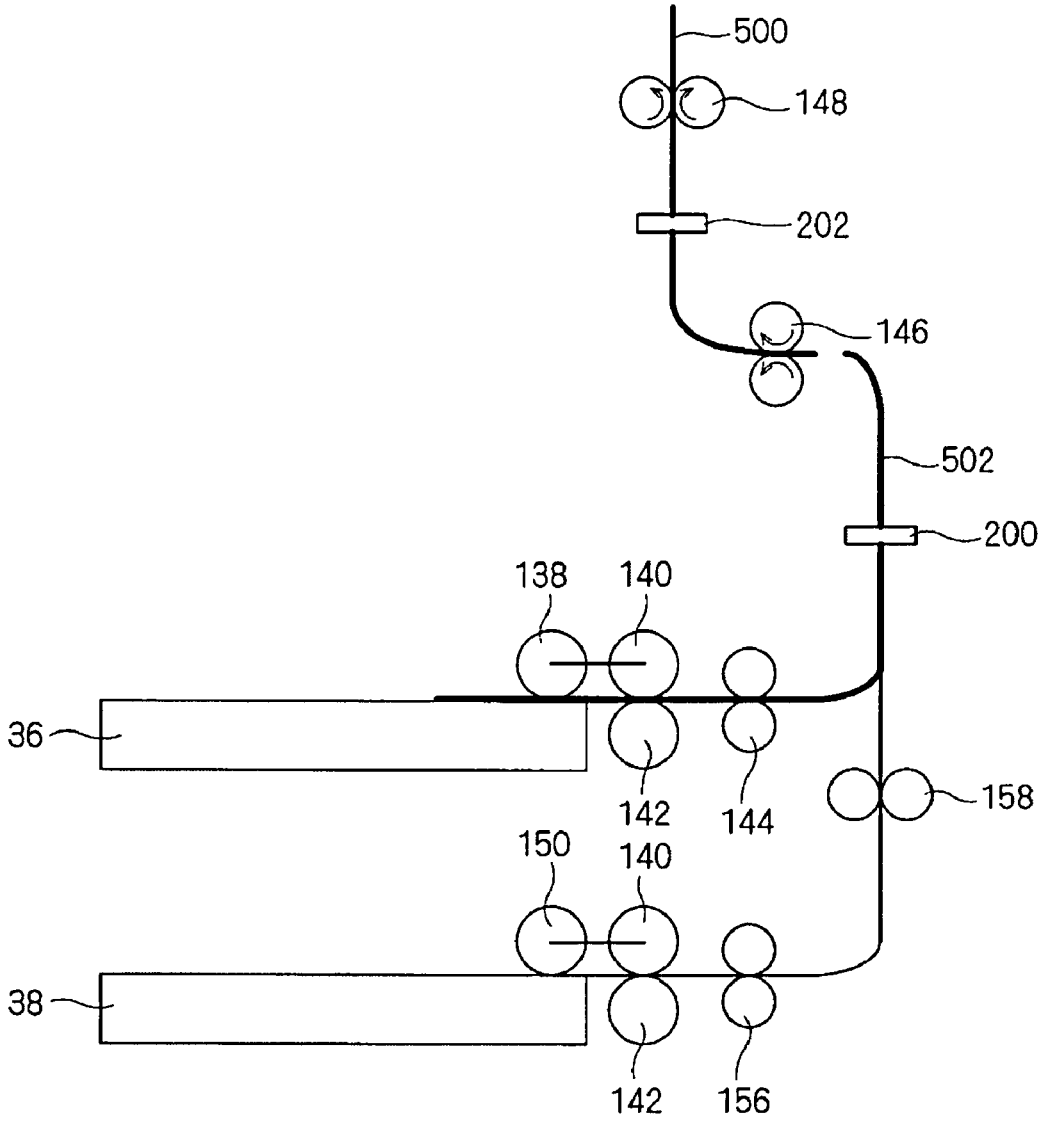
FIG. 12 schematically shows a state when the overlapped feeding occurred and sheet feeding is continued.

FIGS. 11 and 12 assume a situation that a plurality of sheets are continuously fed to the paper feed path from the second paper feed cassette 36.

As shown in FIG. 11, for feeding the sheets, all conveyor rollers 144, 146, 148, 134 and 136 of the sheet feeding system related to the second paper feed cassette 36 are driven. It is noted that FIG. 11 only shows conveyor rollers 144, 146 and 148. If the normal sheet separating operation by pick-up roller 138, paper feed roller 140 and separation roller 142 on the second paper feed cassette 36 fails, overlapped feeding, in which two sheets are fed together with a trailing edge of a preceding sheet 500 and a leading edge of a succeeding sheet 502 overlapped, occurs between the first and second sheet passage sensors 200 and 202.

In the overlapped feeding state, the first sheet passage sensor 200 is turned ON both by the preceding and succeeding sheets 500 and 502. At this time, if the leading edge of preceding sheet 500 has turned ON the second sheet passage sensor 202, it is determined to be an overlapped feeding and sheet feeding is continued as shown in FIG. 12. Specifically, sheet feeding is continued while conveyor rollers 144 on the upstream side in the sheet feeding direction than first sheet passage sensor 200 are stopped and remaining conveyor rollers 146, 148, 134 and 136 are driven.

The overlapped feeding may be eliminated as the preceding and succeeding sheets 500 and 502 are possibly separated by the continued feeding of sheets.

If the states of first and second sheet passage sensors 200 and 202 are unchanged even after the process of continuously feeding the sheets, it is determined to be a feed-failure jam, and sheet feeding is stopped.

The present embodiment attains the following functions and effects.

(1) Even when a plurality of sheets are fed continuously to the paper feed path and the first sheet passage sensor 200 is turned ON both by the preceding sheet 500 and succeeding sheet 502, sheet feeding is continuously executed as it is determined to be overlapped feeding, if the leading edge of preceding sheet 500 has turned ON the second sheet passage sensor 202. Thereafter, if the states of first and second sheet passage sensors 200 and 202 are unchanged, it is determined that a feed-failure jam has occurred, and sheet feeding is stopped. Therefore, it becomes possible to automatically detect and eliminate feed-failure jam caused by overlapped feeding of sheets simply by the combination of ON/OFF of sheet passage sensors 200 and 202 without using a thickness sensor to detect the overlapped feeding. As a result, the burden on the user to remove the sheet can be alleviated.

(2) In the process of continuously feeding the sheets, conveyor rollers 144 on the upstream side in the sheet feeding direction than first sheet passage sensor 200 are stopped and remaining conveyor rollers 146, 148, 134 and 136 are driven. Therefore, the preceding sheet 500 and succeeding sheet 502 can reliably be separated while sheet feeding is continued, to prevent new occurrence of overlapped feeding or feed-failure jam. Thus, smooth operation of continuous sheet feeding is realized.

(3) The leading edge of succeeding sheet 502 fed in the overlapped manner is positioned between the first and second sheet passage sensors 200 and 202. Therefore, if the preceding sheet 500 is the last page of a print job, the succeeding sheet 502 must be discharged without performing any image forming process. In the present feeding control, if the preceding sheet 500 fed in the overlapped manner is the last page of a print job, the sheet following the preceding sheet 500 is discharged without performing any printing process thereon. Therefore, the present invention can easily and advantageously be applied even when a sheet is fed overlapped on a sheet of a last page.

The present invention is not limited to the embodiment above. In the embodiment above, an example has been described in which the present invention is applied to a sheet feeding system related to the second paper feed cassette. The present invention, however, is not limited to such an arrangement. By way of example, the present invention may be applied to the sheet feeding system related to the third paper feed cassette. In that case, for the continuous sheet feeding, driving of two sets of conveyor rollers 156 and 158 on the upstream side in the sheet feeding direction than the first sheet passage sensor 200 should be stopped and remaining conveyor rollers 146, 148, 134 and 136 should be driven. Further, in the embodiment above, an example has been described in which the sheet feeding program is transmitted from another device to the controller through LAN line and NIC and stored in ROM or HDD. The present invention, however, is not limited to such an embodiment. By way of example, a disc drive such as a DVD (Digital Versatile Disk) drive, CD-ROM (Compact Disk-Read Only Memory) drive or FD (Flexible Disk) drive, or a memory port may be provided in place of NIC, and the sheet feeding program recorded on an external recording medium may be introduced to the image forming apparatus thereby. It is naturally understood that various design changes and modifications may be made within the scope of claims as appended to the present specification.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

What is claimed is:

1. A sheet feeding apparatus, comprising:

first and second sheet sensors provided in order from upstream to downstream sides in a sheet feeding direction on a paper feed path through which sheets of paper are fed one by one by a prescribed paper feeder, each sensor outputting a signal that is on when a sheet is detected and off otherwise; and a plurality of sets of sheet conveyor rollers arranged at a plurality of positions along said paper feed path; wherein two or more sheets may possibly be fed partially overlapped from said paper feeder to said paper feed path;

said plurality of sets of sheet conveyor rollers include a group of upstream rollers on the upstream side than said first sheet sensor, and a group of downstream rollers on the downstream side than said first sheet sensor;

said sheet feeding apparatus further comprising:

a roller controller connected to receive output signals of said first and second sheet sensors, and individually controlling said group of upstream rollers and said group of downstream rollers in accordance with a change in value of said output signals; wherein said roller controller includes an overlapped feeding determining device activated in response to start of paper feeding from said paper feeder to said paper feed path, and outputting a determination signal assuming a first value when overlapped feeding of sheets has occurred and a second value otherwise, in response to a change in values of output signals of said first and second sheet sensors, an overlapped feeding eliminating device, temporarily stopping driving of said plurality of sets of sheet conveyor rollers until after the lapse of an idle time to effect print registration of sheets before a register roller positioned at a terminal end of said paper feed path, and after a lapse of the idle time, again driving said group of downstream rollers while driving of said group of upstream rollers is kept stopped, by controlling said roller controller, in response to reception of said determination signal of said first value, and a conveyor roller stopping device stopping said group of downstream rollers in response to failure of overlapped feeding elimination by said overlapped feeding eliminating device; wherein said overlapped feeding determining device includes an overlapped feeding occurrence determining device outputting said determination of signal of said first value, when a prescribed time period passed with the output signal from said first sheet sensor kept on, after the output signals from said first and second sheet sensors changed from off to on in this order.

2. The sheet feeding apparatus according to claim 1, wherein said overlapped feeding eliminating device includes an upstream roller stopping device stopping said paper feeder and said upstream rollers, in response to reception of said determination signal of said first value, and a roller activating device activating said paper feeder and said upstream rollers, in response to a change from on to off of the signal output by said first sheet sensor within a prescribed time period from turning on of said second sheet sensor.

3. The sheet feeding apparatus according to claim 2, wherein said conveyor roller stopping device includes a downstream roller group stopping device stopping said group of downstream rollers when said prescribed time period passed with the signal output from said first sheet sensor kept on, after said upstream rollers were stopped by said upstream roller stopping device.

4. The sheet feeding apparatus according to claim 3, wherein said roller controller further includes a conveyor roller reactivating device activating both said upstream and downstream rollers for feeding a sheet from said prescribed paper feeder to said paper feed path, in response to turning off of both output signals from said first and second sheet sensors after said downstream roller group was stopped by said downstream roller group stopping device.

5. The sheet feeding apparatus according to claim 3, wherein said overlapped feeding occurrence determining device includes a timer activated in response to a change from off to on of the output signal of said first sheet sensor, and a circuit outputting said determination signal that assumes a first value if the output signal of said first sheet sensor is on and a second value if it is off, when a prescribed time is counted by said timer, after the output signal of said second sheet sensor is changed from off to on.

6. The sheet feeding apparatus according to claim 3, wherein said downstream roller group stopping device includes a timer activated when said second sheet sensor is turned on, and a device inspecting an output of said first sheet sensor when a prescribed time is counted by said timer and stopping, if the output is on, said downstream roller group.

7. The sheet feeding apparatus according to claim 2, wherein said overlapped feeding occurrence determining device includes a timer activated in response to a change from off to on of the output signal of said first sheet sensor, and a circuit outputting said determination signal that assumes a first value if the output signal of said first sheet sensor is on and a second value if it is off, when a prescribed time is counted by said timer, after the output signal of said second sheet sensor is changed from off to on.

8. The sheet feeding apparatus according to claim 2, wherein said roller activating device includes a timer activated when said second sheet sensor is turned on, and a device inspecting an output of said first sheet sensor when a prescribed time is counted by said timer and activating, if the output is off, said paper feeder and said upstream rollers.

9. The image forming apparatus according to claim 8, further comprising a discharge device discharging, when two or more sheets are fed in partially overlapped manner to said paper feed path and a preceding sheet is for printing last page of said image data, a sheet following the preceding sheet without performing printing process.

10. The sheet feeding apparatus according to claim 1, wherein said overlapped feeding occurrence determining device includes a timer activated in response to a change from off to on of the output signal of said first sheet sensor, and a circuit outputting said determination signal that assumes a first value if the output signal of said first sheet sensor is on and a second value if it is off, when a prescribed time is counted by said timer, after the output signal of said second sheet sensor is changed from off to on.

11. The sheet feeding apparatus according to claim 1, comprising only a pair of said conveyor rollers between said first and second sheet sensors.

12. An image forming apparatus, comprising:

a sheet feeding apparatus feeding sheets of paper on a paper feed path on which sheets of paper are fed one by one by a prescribed paper feeder; and an image forming unit printing image data on the sheet fed through said paper feed path; wherein said sheet feeding apparatus includes first and second sheet sensors provided in order from upstream to downstream sides in a sheet feeding direction on said paper feed path, each sensor outputting a signal that is on when a sheet is detected and off otherwise, and a plurality of sets of sheet conveyor rollers arranged at a plurality of positions along said paper feed path; wherein two or more sheets may possibly be fed partially overlapped from said paper feeder to said paper feed path;

said plurality of sets of sheet conveyor rollers include a group of upstream rollers on the upstream side than said first sheet sensor, and a group of downstream rollers on the downstream side than said first sheet sensor;

said sheet feeding apparatus further comprising:

a roller controller connected to receive output signals of said first and second sheet sensors, and individually controlling said group of upstream rollers and said group of downstream rollers in accordance with a change in value of said output signals; wherein said roller controller includes an overlapped feeding determining device activated in response to start of paper feeding from said paper feeder to said paper feed path, and outputting a determination signal assuming a first value when overlapped feeding of sheets has occurred and a second value otherwise, in response to a change in values of output signals of said first and second sheet sensors, an overlapped feeding eliminating device, temporarily stopping driving of said plurality of sets of sheet conveyor rollers until after the lapse of an idle time to effect print registration of sheets before a register roller positioned at a terminal end of said paper feed path, and after a lapse of the idle time, again driving said group of downstream rollers while driving of said group of upstream rollers is kept stopped, by controlling said roller controller, in response to reception of said determination signal of said first value, and a conveyor roller stopping device stopping said group of downstream rollers in response to failure of overlapped feeding elimination the process for eliminating overlapped feeding by said overlapped feeding eliminating device; wherein said overlapped feeding determining device includes an overlapped feeding occurrence determining device outputting said determination of signal of said first value, when a prescribed time period passed with the output signal from said first sheet sensor kept on, after the output signals from said first and second sheet sensors changed from off to on in this order.

13. A method of sheet feeding, in a sheet feeding apparatus including first and second sheet sensors provided in order from upstream to downstream sides in a sheet feeding direction on a paper feed path through which sheets of paper are fed one by one by a prescribed paper feeder, each sensor outputting a signal that is on when a sheet is detected and off otherwise, and a plurality of sets of sheet conveyor rollers arranged at a plurality of positions along said paper feed path; wherein two or more sheets may possibly be fed partially overlapped from said paper feeder to said paper feed path;

said plurality of sets of sheet conveyor rollers include a group of upstream rollers on the upstream side than said first sheet sensor, and a group of downstream rollers on the downstream side than said first sheet sensor; and said sheet feeding apparatus further includes a roller controller connected to receive output signals of said first and second sheet sensors, and individually controlling said group of upstream rollers and said group of downstream rollers in accordance with a change in value of said output signals;

said sheet feeding method comprising:

the step, started in response to start of paper feeding from said paper feeder to said paper feed path, of outputting a determination signal assuming a first value when overlapped feeding of sheets has occurred and a second value otherwise, in response to a change in values of output signals of said first and second sheet sensors;

the step of temporarily stopping driving of said plurality of sets of sheet conveyer rollers until after a lapse of an idle time to effect print registration of sheets before a register roller positioned at a terminal end of said paper feed path, and after the lapse of the idle time, again driving said group of downstream rollers while driving of said group of upstream rollers is kept stopped, by controlling said roller controller, in response to reception of said determination signal of said first value; and the step of stopping said group of downstream rollers in response to failure of overlapped feeding elimination at said step of driving; wherein said step of outputting includes the step of outputting said determination signal of said first value, when a prescribed time period passed with the input signal from said first sheet sensor kept on, after the output signals from said first and second sheet sensors changed from off to on in this order.

* * * * *